United States Patent [19]

Doublet et al.

[11] Patent Number: 4,658,804

[45] Date of Patent: Apr. 21, 1987

[54] MOVABLE HEARTH BOILER WITH INTERNAL COMBUSTION AND ADJUSTABLE DRAUGHT

[76] Inventors: Daniel Doublet, Route du Sap Beuvillers, 14100 Lisieux; Arja Pynnonen; Daniel Pontoizeau, both of Valseme, 14340 Cambrener, all of France

[21] Appl. No.: 648,183

[22] Filed: Sep. 4, 1984

Related U.S. Application Data

[60] Continuation of PCT/FR 83/00258, filed on Dec. 23, 1983 published as WO 84/02764 on Jul. 19, 1984.

[30] Foreign Application Priority Data

Jan. 3, 1983 [FR] France ..... 83 00005

[51] Int. Cl.[4] ..... A47J 27/00

[52] U.S. Cl. ..... 126/391; 126/132; 126/34; 126/120

[58] Field of Search ..... 126/13, 30, 34, 25 R, 126/26, 9 R, 120, 391, 389, 377, 137, 132, 351

[56] References Cited

U.S. PATENT DOCUMENTS

| | | | |
|---|---|---|---|
| 845,993 | 3/1907 | Appleby et al. | 126/391 |
| 1,637,617 | 8/1927 | Kralik | 126/391 X |
| 2,678,039 | 5/1954 | Keating | 126/391 |
| 2,805,658 | 9/1957 | Schlueter | 126/30 |
| 4,164,931 | 8/1979 | Jenkins . | |

FOREIGN PATENT DOCUMENTS

| | | | |
|---|---|---|---|
| 552611 | 6/1922 | France . | |
| 667382 | 10/1929 | France | 126/391 |
| 1315543 | 12/1962 | France | 126/391 |
| 2475695 | 2/1980 | France . | |
| 2484613 | 6/1980 | France . | |
| 1004 | of 1895 | United Kingdom | 126/391 |

*Primary Examiner*—Randall L. Green
*Attorney, Agent, or Firm*—Larson and Taylor

[57] ABSTRACT

An open hearth boiler includes a body intended to be positioned above an open hearth. Inflow and outflow pipes are connected to the body and to a central heating or hot water circuit. The body includes internal combustion chambers which contact the flames and combustion gases. The combustion chambers are spaced from one another and baffles between various chambers define a spiral internal circulation circuit for a heat exchange fluid in the body.

12 Claims, 6 Drawing Figures

MOVABLE HEARTH BOILER WITH INTERNAL COMBUSTION AND ADJUSTABLE DRAUGHT

Figure 1:
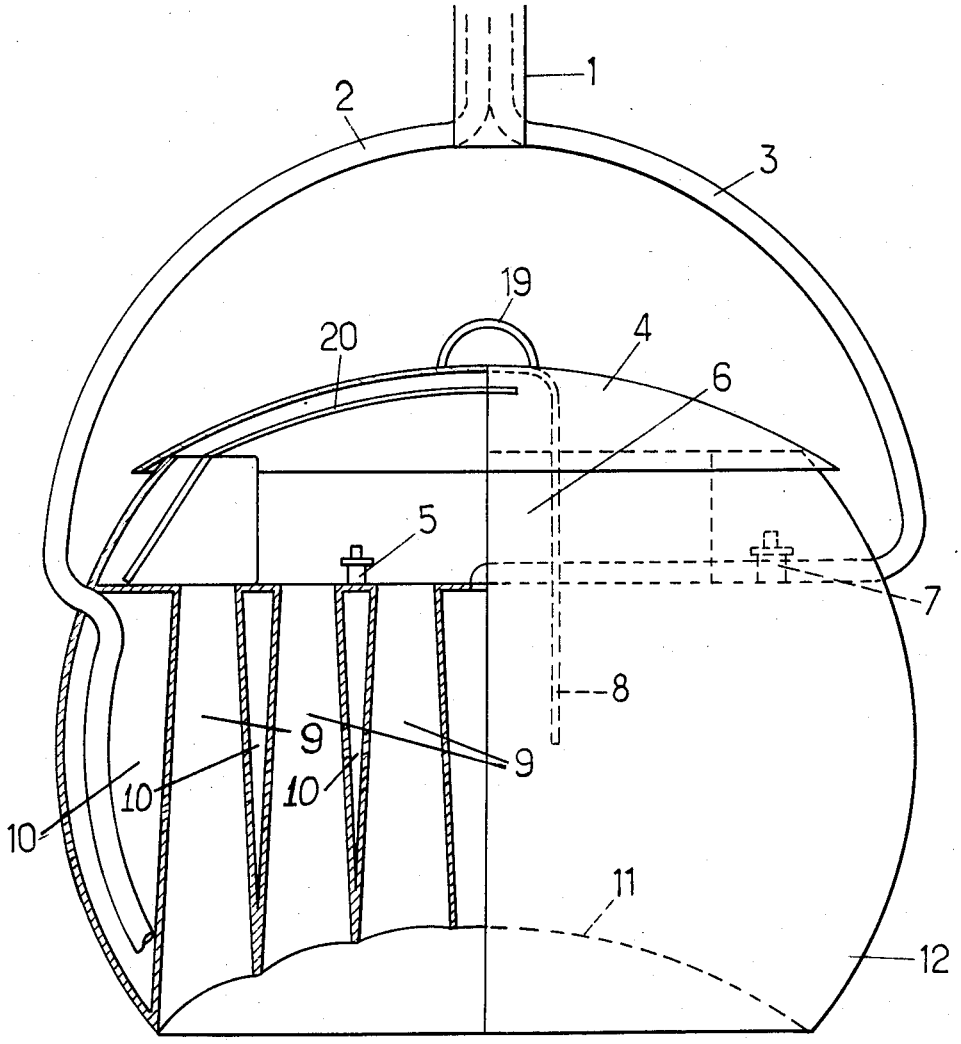

Continuation of PCT/FR 83/00258, filed on Dec. 23, 1983, published as WO 84/02764 on Jul. 19, 1984.

The present invention relates to heat recovery devices for wood fires in open hearth chimneys using heat transfer fluids.

The technical problem set with wood fires is that of recovering and restoring in optimum manner the energy released by a wood fire in an open hearth chimney whilst preserving the aesthetics and characteristics of the chimney.

At present, the major part of the energy is lost into the open air or is recovered to a mediocre extent by energy recovery devices which offer poor yields coupled with very questionable aesthetics.

The problem of the mediocre yield of heat recovery devices is due to their poor position with respect to the heat source, which position is associated with aesthetic considerations. In addition, being static, they do not take into account changes in the fire.

The ideal position is situated above and closest to the open hearth fire of the chimney, in the most visible portion of the hearth.

An approach in this direction has been presented in French Pat. No. 2484 613 which proposes a boiler device intended for central heating. However, the latter does not offer any really advantageous features; and the lack of performance is obvious since a kettle can in no way obtain the yield of a boiler, all the more since it is static.

The features of the claims of this prior French patent are as follows:

Claim 1. "The quality of the water contained in the kettle permits the supply of several radiators."

It should be appreciated that this feature is common to all fluid hearth recovery devices.

Claim 2. "The removability of the cover enables only the production of sanitary hot water."

Now in the device according to the present invention, the production of sanitary hot water is in no way connected with the removability of the cover.

Claim 3. "The kettle is provided with a handle to be hooked onto a rack."

This feature is also inherent in any kettle.

The features of the 4th and 5th claims are without object as regards the device according to our invention.

The essential virtues of a heat recovery boiler are: to trap; to channel; to concentrate in its core the heat, the flames, and the combustion gases released by the wood fire in the hearth; and to restore this heat, without altering the aesthetics of the chimney.

The device according to the invention enables these technical and aesthetic requirements to be reconciled whilst offering high performance. It has in fact the particularity of being situated vertically over the hearth at the heart itself of the heat source and constitutes with the open hearth fire a true boiler of high yield.

The boiler, according to our invention has the features and advantages as follows. It is an open hearth boiler using fluids as a heat-transfer agent. The internal combustion takes place in numerous combustion chambers. These combustion chambers have a downwardly open conical shape to brake the combustion gases and the hot fumes, obliging them to lick along their inner wall. Thus, the value of the combustion is optimally obtained by increasing the heat exchange.

The bottom of the boiler is characterized by its parabolic shape which is designed to trap, channel and concentrate the combustion gases, the flames and the hot fumes inside the boiler wherein the exchange is effected.

The heat exchange is done by a fluid in a forced spiral circuit defined by baffles across the whole body of the boiler around the multiple combustion chambers. These multiple combustion chambers enable a large heat surface to be obtained with respect to the diameter of the boiler. The combustion chambers open into a fume collector situated at the top of the boiler. In its rear portion, the collector is provided with a damper device which is automatically regulated by a thermostat of the spiral type which, in expanding, acts on the damper device situated above the apparatus. This adjustment facilitates the efficient consumption of the fuel. A manual position permits, due to complete obturation of the damper device, the use of the chimney continuously as long as the fire is lit.

Technical study of the shapes (bottom of the boiler combustion chambers and the evacuation duct for the fumes towards the bottom of the hearth) enables the defective draught of certain chimneys to be substantially improved.

The upper portion of the boiler constitutes an inspection trap giving access to the automatic and manual damper device, to the fume collector, to the combustion chambers, to an automatic purger and to a safety valve.

A suspension device, fastened to the boilers, enables the boiler to be positioned continuously closest and vertically over the heat source by gravity as a function of the change in the height of the source of the fire in the chimney.

This sliding suspension device is compensated by a spring which reduces the vertical pressure of the boiler on the logs. It also hides the connecting pipes. It comprises a locking device which enables the boiler to be held in high position for supplying the hearth with fuel.

A hinged post supports the sliding suspension device, fastened to the boiler through its supply pipes. It is fixed to the remote wall of the chimney in the top part of the hood. The articulation of this post enables lateral movement of the boiler which offers the possibility to the user of following better the horizontal change in the wood fire or to free a portion of the hearth for other purposes (spit, grill...). These horizontal and vertical movements of the boiler are possible since it is connected to the central heating circuit through flexible pipes suitable for use under the conditions of heat and pressure. The connection of these flexible pipes is done by means of fluid-tight hydraulic connectors called "rapid type". This permits the instantaneous taking down and replacement of the boiler and of its suspension device, procuring the following advantages: disengagement of the hearth for use of a grill or spit, for sweeping and for use of the same boiler in various chimneys previously provided with the same connecting device (secondary residences).

Figure 3:
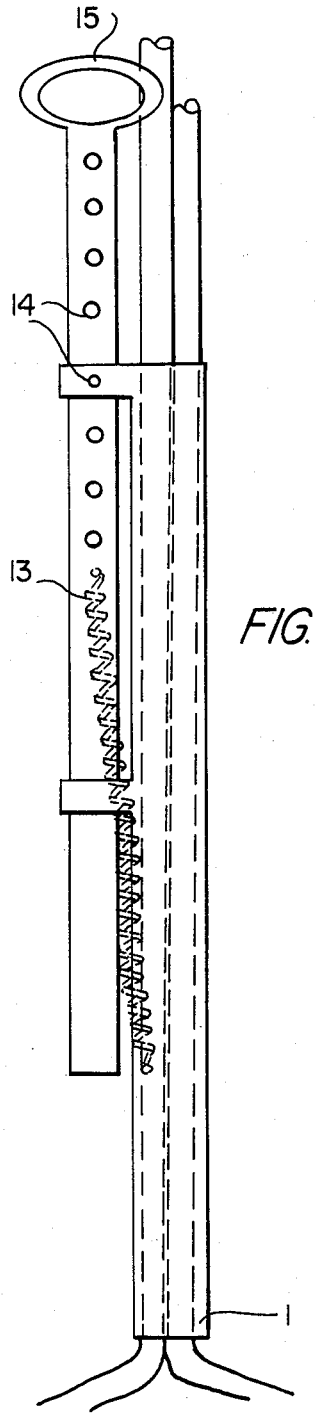
Figure 2:
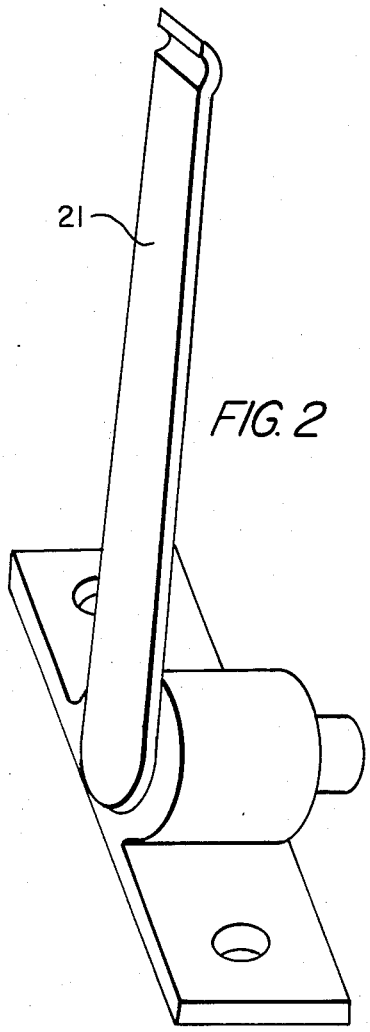
Figure 4:
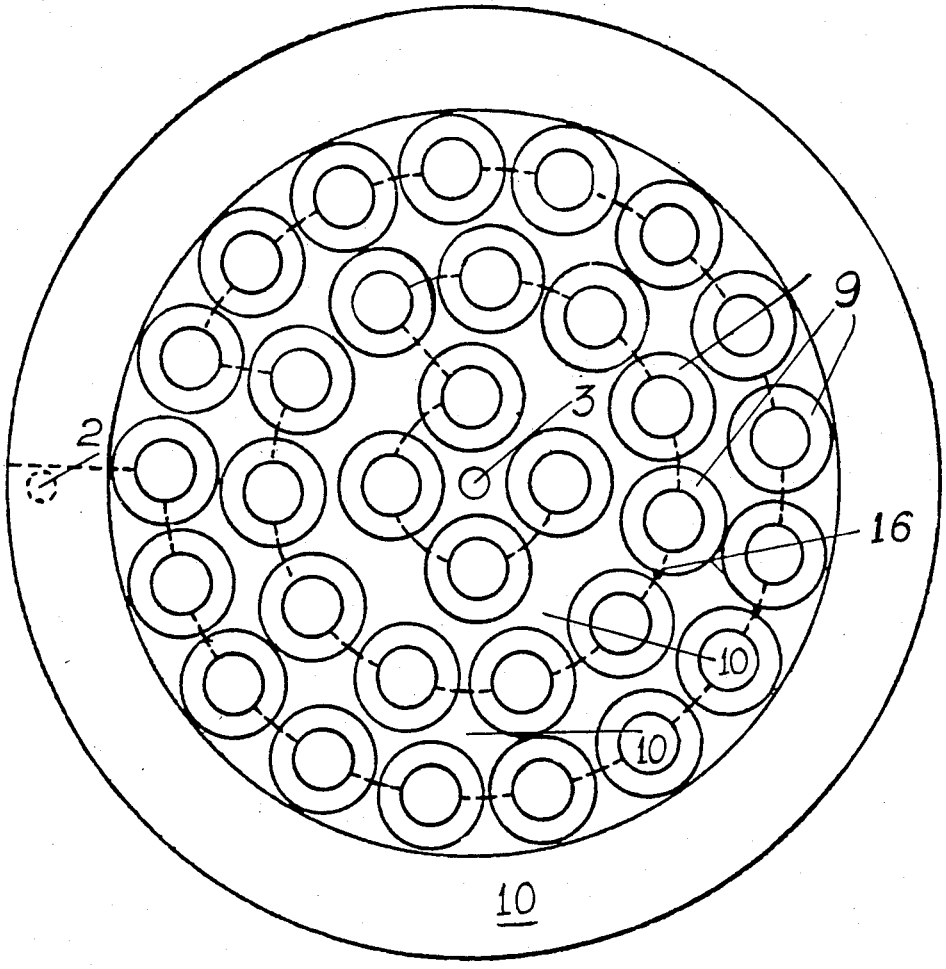
Figure 5:
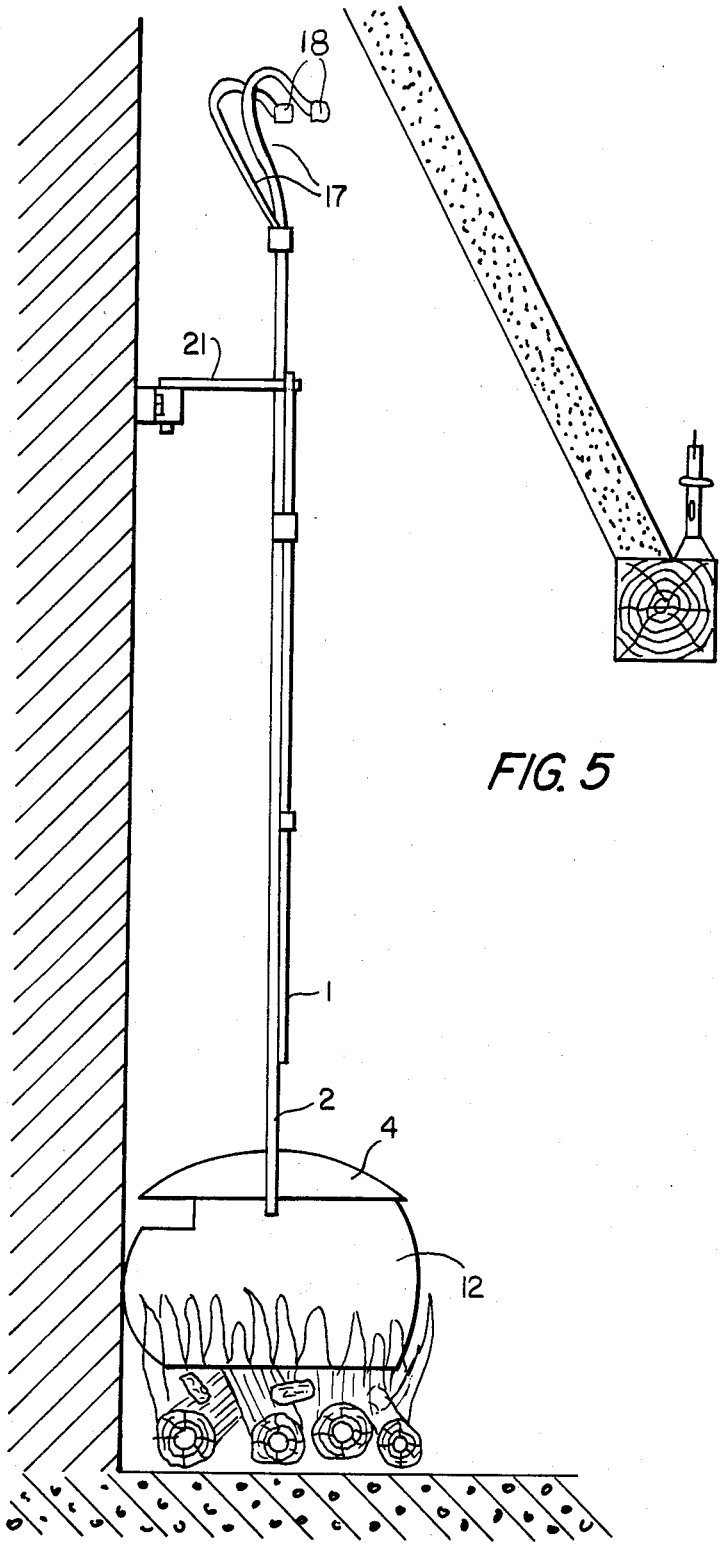
Figure 6:
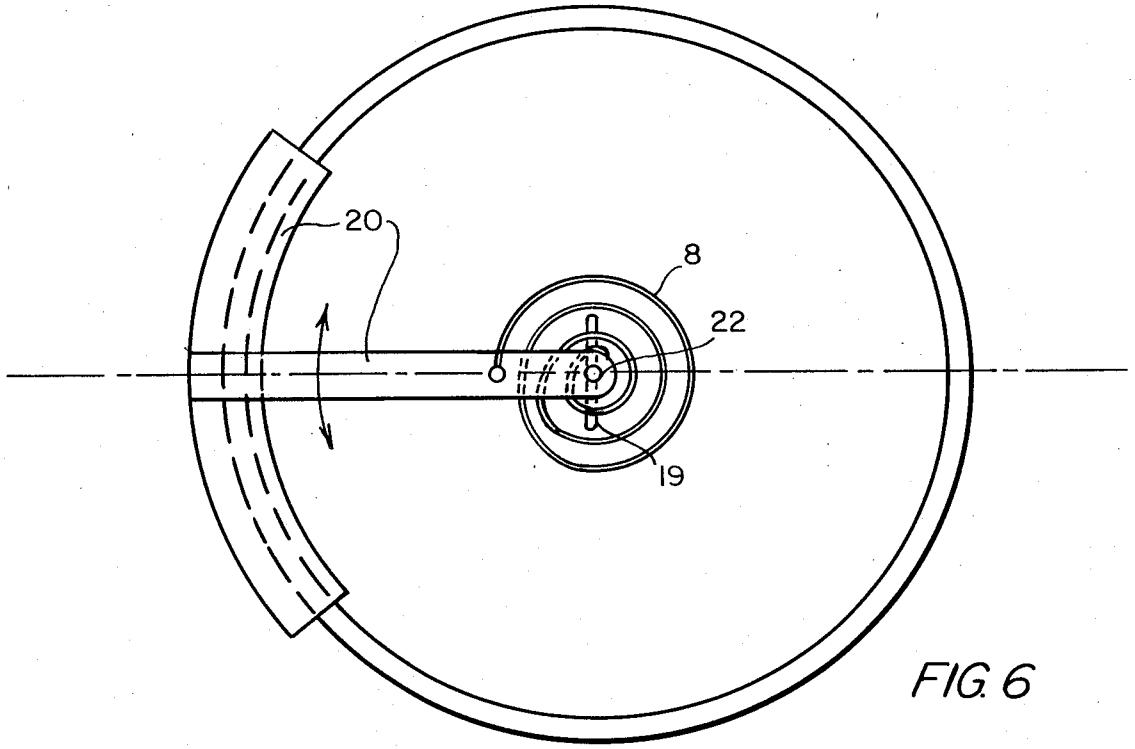

According to a preferred embodiment, FIG. 1 shows a ¼ section left front view of the boiler according to the invention. FIG. 2 shows in a perspective view the hinged post (21). FIG. 3 shows in a front view the suspension device. FIG. 4 shows in a view from below the boiler according to the invention. FIG. 5 shows in a left-hand view the complete device positioned in the hearth. FIG. 6 shows in a bottom view the inspection trap (4) in the upper portion of the boiler.

According to a preferred embodiment, FIG. 1 shows the boiler characterized by the bulged lateral body (12) whose specially designed shape offers the following feature: the lower portion enables the recovery of heat by exchange contact with the flames, whilst the upper portion returns this heat by radiation to the room.

The bottom of the boiler (11) is of parabolic shape and opens into the multiple conical vertical combustion chambers (9) which are connected to one another vertically by baffles (16) forcing the fluid (10) through the boiler. These combustion chambers (9) open into a fume collector (5) which regulates the flow rate of combustion gases by a damper device (20) actuated either by a thermostatic probe (8) for the fluid (10) or by a handle (19). The upper portion of the boiler constitutes an inspection trap (4).

The boiler is suspended by its own cold (2) and hot (3) supply pipes which are extended by flexible pipes (17) and connections (18) to a sliding device (FIG. 3). The sliding device is provided with a locking system (14) and a compensating spring (13). This device is hooked by a ring (15) to an articulated post (21) (FIG. 2).

The device according to the invention constitutes with the hearth fireplace a true boiler. This boiler caps, traps and stores the flames and the vertical combustion gases (9) by which heat exchange is effected with the fluid (10). The fluid is forced to circulate by baffle (16) welded vertically between each combustion chamber.

This boiler whose body represents the shape of a pot can be formed of copper whose conductivity and radiation properties are excellent.

The removal of the burned gases is controlled by a damper device (20) with automatic and manual regulation (FIG. 5). The damper device (20) obturates the evacuation duct situated in the top portion of the boiler near its rear surface.

To follow the change in the wood fire in the chimney, the boiler has been designed to be continuously movable by means of a sliding suspension (FIG. 3) formed of forged iron provided with a spring (13) enabling the pressure of the boiler on the logs to be controlled. A locking system (14) enables the boiler to be held in top position for supplying the fire with fuel.

The boiler is made fast to this sliding suspension by the supply pipes, which are recommended to be made of brass. The supply pipes are fixed by flanges to the back of the device which flanges hide them.

An articulated post (FIG. 2) is fixed to the bottom wall of the chimney by means of two screws. The boiler suspension device assembly is hooked to this post and this enables side movement of the boiler.

This vertical and horizontal mobility of the boiler is made possible by the use of known inox flexibles (such as a heat resistant internal plastic tube covered by a deformable stainless steel tube).

The "removability" of the assembly is achieved instantaneously by means of rapid disconnect hydraulic connectors (18).

The technical characteristics of the device according to the invention form thereof a high performance entirely separate boiler justifying its use as a main boiler. It can also be used to replace an existing boiler.

The high temperatures obtained inside the combustion chambers make the boiler self-cleaning and thus no maintenance is required.

The design of the boiler enables its operation as a thermosiphon, however, its high yield justifies use of a circulator.

Sanitary hot water is obtained from a flask independent of the device according to the invention.

The outer shape of the preferred technical construction of the body of the boiler, according to our studies, are those which have been traditionally adopted by our ancestors for utensils which had to be suspended above the chimney fireplace such as pots, pans, fish-kettle cauldrons, kettles, warming pans, etc...

These attractive shapes enable the aesthetics and performance to be reconciled, thus responding perfectly to the problem posed in hearth recovery devices.

The technical portion of the invention is totally hidden and affords easy installation and connection. It is effected without any modification (no visible pipe, piercing only of two 30 mm holes in the chimney duct for connecting to the installation, and fixing of the post in the upper part of the hood by two screws) and only leaves visible a utensil shape which has a natural appearance in a chimney.

Consequently, this hearth recovery boiler is adapted to any type of open hearth chimney and in particular to period and style chimneys.

It will be noted that the above description has only been given by way of example and that constructive additions or modifications could be made thereto without departing from the scope of the invention defined by the appended claims.

We claim:

1. An open hearth boiler for use in a hearth having a burning combustion source producing flames and combustion gases, comprising:

a body intended to be positioned vertically above the combustion source through which a heat transfer fluid flows, said body having (a) vertical internal combustion chambers separated horizontally from one another and having walls which are adapted to be vertically traversed by the flames and combustion gases, said wall providing heat exchange surfaces for the exchange of heat energy between the burning combustion source and the fluid in said body, and (b) a partition means for vertically partitioning selected adjacent combustion chambers to form an internal circulation circuit for the heat transfer fluid having an inlet and an outlet;

an inflow pipe and an outlfow pipe connected, respectively, to said inlet and said outlet; and a suspension means for vertically maintaining said body in continuous contact with a top portion of the combustion source as the combustion source is depleted, said suspension means including a compensating means for reducing the vertical pressure exerted on the top of the combustion source by the weight of said body.

2. Boiler according to claim 1, wherein said internal combustion chambers traverse said body between its bottom, intended to come into contact with the combustion source, and an upper portion arranged as a fume collector, which communicates with the outside through an evacuation opening.

3. Boiler according to claim 2, wherein the walls of said internal combustion chambers are constituted by surfaces of revolution, of practically vertical axis.

4. Boiler according to claim 3, wherein said surfaces of revolution are conical surfaces.

5. Boiler according to claim 2, wherein the bottom of said body is of at least approximately parabolic shape.

6. Boiler according to claim 2, wherein said evacuation opening of the fume collector is obturated by a movable flap controlled with automatic regulation by a thermostat.

7. Boiler according to claim 2, wherein said fume collector is obturated by a removable cover constituting an inspection trap, which gives access to said fume collector, to said inner combustion chambers, to an automatic purger, and to a safety valve.

8. Boiler according to claim 1, wherein said partition means for said internal circulation circuit includes metal baffles connecting each time to neighboring chambers, these baffles constituting together, between the inflow pipe and the outflow pipe an internal flow circuit of generally spiral shape.

9. Boiler according to claim 1, wherein said suspension means suspends said body through said inflow and outflow pipes.

10. Boiler according to claim 9 wherein said compensating means comprises a compensating spring to which is hooked a fastening system for said pipes.

11. Boiler according to claim 9, wherein said suspension means is supported by an articulated post, enabling regulation of the lateral position of said body, with respect to the hearth.

12. Boiler according to claim 1, wherein said inflow and outflow pipes for said heat transfer fluid include flexible pipes and hydraulic rapid connectors.

* * * * *